US010759026B2

(12) United States Patent
Yang

(10) Patent No.: US 10,759,026 B2
(45) Date of Patent: Sep. 1, 2020

(54) VISE WITH AN ADJUSTABLE OPERATING ANGLE

(71) Applicant: Po-Hsien Yang, Taichung (TW)

(72) Inventor: Po-Hsien Yang, Taichung (TW)

( * ) Notice: Subject to any disclaimer, the term of this patent is extended or adjusted under 35 U.S.C. 154(b) by 153 days.

(21) Appl. No.: 16/211,661

(22) Filed: Dec. 6, 2018

(65) Prior Publication Data

US 2020/0180115 A1 Jun. 11, 2020

(51) Int. Cl.

| | |
|---|---|
| ***B25B 1/22*** | (2006.01) |
| ***B25B 1/10*** | (2006.01) |
| ***B25B 1/02*** | (2006.01) |

(52) U.S. Cl.

CPC ..... *B25B 1/22* (2013.01); *B25B 1/02* (2013.01); *B25B 1/103* (2013.01)

(58) Field of Classification Search

USPC ..... 269/71, 72, 73, 76, 79, 84

See application file for complete search history.

(56) References Cited

U.S. PATENT DOCUMENTS

| | | | | |
|---|---|---|---|---|
| 2,371,435 A * | 3/1945 | Galorneau | ..... | B25B 1/22 269/71 |
| 3,053,557 A * | 9/1962 | Beyer | ..... | B25B 1/22 403/97 |
| 3,815,892 A * | 6/1974 | Tulk | ..... | B23Q 1/545 269/75 |

* cited by examiner

*Primary Examiner* — Joseph J Hail
*Assistant Examiner* — Shantese L McDonald
(74) *Attorney, Agent, or Firm* — Egbert Law Offices, PLLC

(57) ABSTRACT

A vise with an adjustable operating angle includes a base member, a front pier and a rear pier disposed on two opposite ends of the base member. A rotary seat mounted onto the front pier and the rear pier. A platform is pivoted to the front pier and the rear pier. A fixed jaw is secured on a rear end of the platform and a movable jaw is movably mounted on the platform. A lead screw is disposed in the platform for driving the movable jaw. A front turntable and a rear turntable are disposed to two opposite ends of the platform and rotatably disposed on the front pier and the rear pier. A front fastening seat and a rear fastening seat are mounted onto the front pier and the rear pier for selectively holding the front turntable and the rear turntable in place.

6 Claims, 9 Drawing Sheets

VISE WITH AN ADJUSTABLE OPERATING ANGLE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a vise, and more particularly to a vise with an adjustable operating angle.

2. Description of Related Art Including Information Disclosed Under 37 CFR 1.97 and 37 CFR 1.98

A conventional vise has a fixed seat such that a wedge washer is provided under the workpiece such that the workpiece is inclined relative to the fixed seat when the workpiece needs to be processed at a specific angle. However, the standards of the wedge washer are limited such that the main shaft of the processing machine also needs to be adjusted. It is inconvenient to the conventional vise when the workpiece needs to be processed at a specific angle.

In view of this, some vises with an adjustable operating angle are on the market for adjusting the operating angle of the workpiece by the structures of the vise. The conventional vises have two adjusting types including swing left and right relative to two opposite sides and swing back and forth relative to two opposite ends. As well known, a distance between two opposite ends of the vise is greater than that between the two opposite sides of the vise. As a result, the vise, in the type of swing back and forth, has a greater adjusting range and the adjusting range may intervene the operating room of the processing machine.

BRIEF SUMMARY OF THE INVENTION

The main objective of the present invention is to provide an improved vise that has an adjustable operating angle.

To achieve the objective, the vise with an adjustable operating angle in accordance with the present invention comprises a base member formed with a bottom and a top surface. A front pier and a rear pier are respectively formed on a front end and a rear end of the top surface of the base member. Each of the front pier and the rear pier is formed with a contact surface. Each of the two contact surfaces has a semicircular groove defined therein. A flange is formed on a bottom of each of the two semicircular grooves. A rotary seat is mounted onto the front pier and the rear pier. The rotary seat includes a platform, a fixed jaw, a movable jaw, a lead screw and a power brake, wherein the platform is pivoted to the front pier and the rear pier. The fixed jaw is secured on a rear end of the platform and the movable jaw is movably mounted onto the platform. The lead screw is rotatably mounted in the platform for driving the movable jaw and making the movable jaw reciprocally moved relative to the platform. The power brake is disposed on a front end of the lead screw and extends through the front pier. The power brake includes power force elements disposed therein for enhancing a clamping effect of the fixed jaw and the movable jaw and providing an anti-loose function. A front turntable and a rear turntable are respectively secured on a front end and the rear end of the platform. Each of the front turntable and the rear turntable is a circular structure and co-axially corresponding to the lead screw. The front turntable and rear turntable respectively has a bottom half selectively rotatably received in the semicircular groove of a corresponding one of the front pier and the rear pier. The flange of the front pier and the flange of the rear pier respectively inwardly and movably abut against the front turntable and the rear turntable. The front turntable has a through hole co-axially defined therein, wherein the front end of the lead screw extends through the through hole in the front turntable. A front fastening seat and a rear fastening seat are respectively mounted onto the front pier and the rear pier. The front fastening seat and the rear fastening seat respectively includes a contact surface formed on a bottom of each of the front fastening seat and the rear fastening seat, wherein the contact surface of the front fastening seat abuts the contact surface of the front pier and the contact surface of the rear fastening seat abuts the contact surface of the rear pier. The contact surfaces of each of the front fastening and the rear fastening seat has a semicircular groove defined therein. A flange is formed on a bottom of each of the two semicircular grooves of the front fastening seat and the rear fastening seat. The front turntable has an upper half selectively rotatably received in the semicircular groove in the front fastening seat and the rear turntable has an upper half selectively rotatably received in the semicircular groove in the rear fastening seat. Multiple fastening members are provided to control a loose/tight condition between the front fastening seat/rear fastening seat and the front pier/rear pier. In the preferred embodiment of the present invention, the multiple fastening members are multiple bolts. At least two threaded holes are defined in the contact surface of each of the front pier and the rear pier. At least two through holes 705/805 are defined in the contact surface of each of the front fastening seat and the rear fastening seat, wherein each through hole in the front fastening seat aligns with a corresponding one of the at least two threaded holes in the front pier and each through hole in the rear fastening seat aligns with a corresponding one of the at least two threaded hole in the rear pier. Each fastening member extends through a corresponding one of the through holes in each of the front fastening seat and the rear fastening seat, and is tightly screwed into a corresponding one of the threaded hole in each of the front pier and the rear pier such that the front pier and the front fastening seat tightly clamp the front turn table, and the rear pier and the rear fastening seat tightly clamp the rear turntable. On the contrary, when all the fastening members is loosed, the front pier and the front fastening seat release the front turn table, and the rear pier and the rear fastening seat release the rear turntable such that the rotary seat is rotatable relative to the base member and the operating angle of the rotary seat is adjusted relative to the base member.

Further benefits and advantages of the present invention will become apparent after a careful reading of the detailed description with appropriate reference to the accompanying drawings.

DETAILED DESCRIPTION OF THE INVENTION

Figure 1:
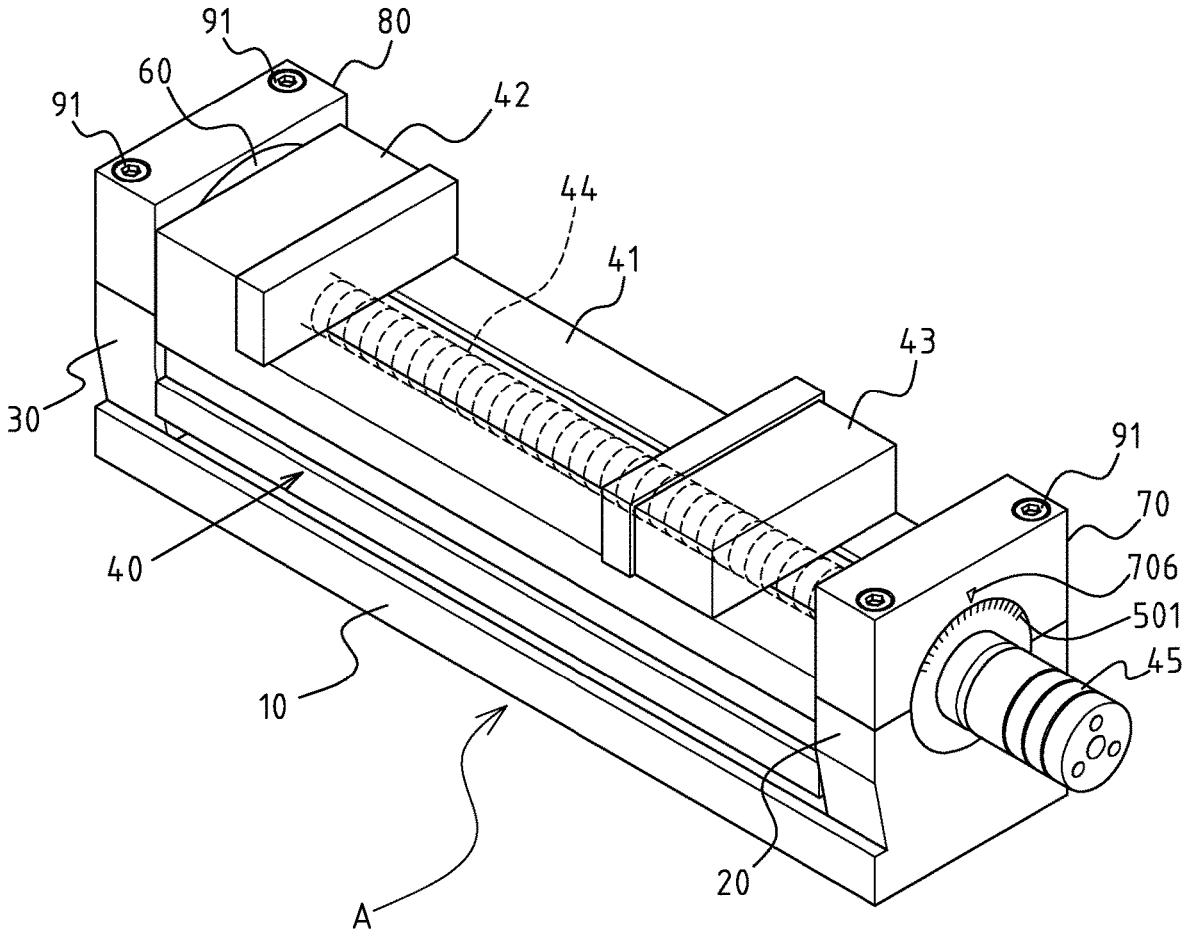
FIG. 1 is a perspective view of a first preferred embodiment of a vise with an adjustable operating angle in accordance with the present invention.
Figure 2:
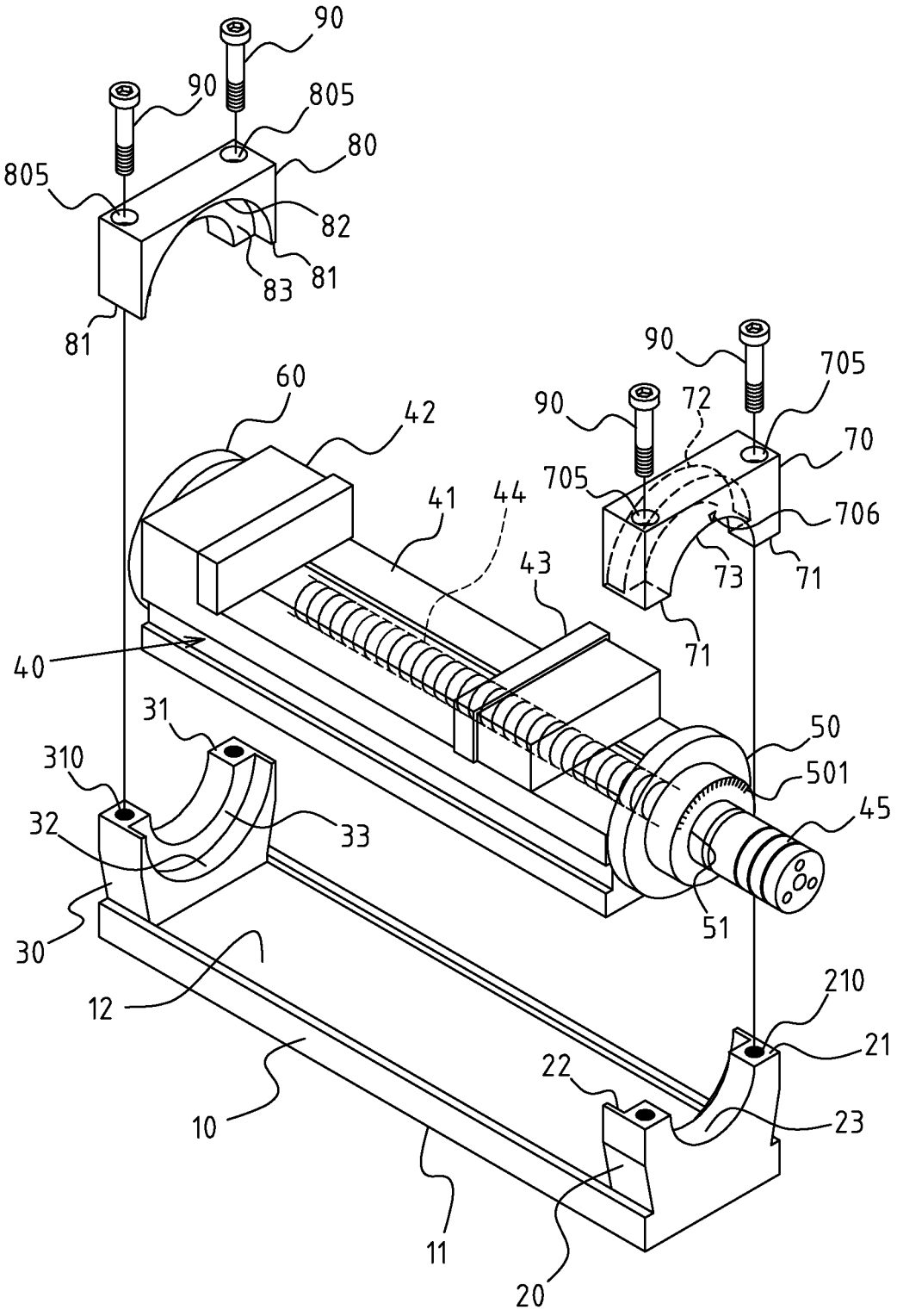
FIG. 2 is an exploded perspective view of the vise in FIG. 1.

Referring to the drawings and initially to FIGS. 1 and 2, a vise A with an adjustable operating angle in accordance with the present invention comprises a base member 10 formed with a bottom 11 and a top surface 12. A front pier 20 and a rear pier 30 are respectively formed on a front end and a rear end of the top surface 12 of the base member 10. Each of the front pier 20 and the rear pier 30 is formed with a contact surface 21/31. Each of the two contact surfaces 21/31 has a semicircular groove 22/32 defined therein. A flange 23/33 is formed on a bottom of each of the two semicircular grooves 22/32. A rotary seat 40 is mounted onto the front pier 20 and the rear pier 30. The rotary seat 40 includes a platform 41, a fixed jaw 42, a movable jaw 43, a lead screw 44 and a power brake 45, wherein the platform 41 is pivoted to the front pier 20 and the rear pier 30. The fixed jaw 42 is secured on a rear end of the platform 41 and the movable jaw 43 is movably mounted onto the platform 41. The lead screw 44 is rotatably mounted in the platform 41 for driving the movable jaw 43 and making the movable jaw 43 reciprocally moved relative to the platform 41. The power brake 45 is disposed on a front end of the lead screw 44 and extends through the front pier 20. The power brake 45 includes power force elements disposed therein for enhancing a clamping effect of the fixed jaw 42 and the movable jaw 43 and providing an anti-loose function.

A front turntable 50 and a rear turntable 60 are respectively secured on a front end and the rear end of the platform 41. Each of the front turntable 50 and the rear turntable 60 is a circular structure and co-axially corresponding to the lead screw 44. The front turntable 50 and rear turntable 60 respectively has a bottom half selectively rotatably received in the semicircular groove 22/32 of a corresponding one of the front pier 20 and the rear pier 30. The flange 23 of the front pier 20 and the flange 33 of the rear pier 30 respectively inwardly and movably abut against the front turntable 50 and the rear turntable 60. The front turntable 50 has a through hole 51 co-axially defined therein, wherein the front end of the lead screw 44 extends through the through hole 51 in the front turntable 50.

A front fastening seat 70 and a rear fastening seat 80 are respectively mounted onto the front pier 20 and the rear pier 30. The front fastening seat 70 and the rear fastening seat 80 respectively includes a contact surface 71/81 formed on a bottom of each of the front fastening seat 70 and the rear fastening seat 80, wherein the contact surface 71 of the front fastening seat 70 abuts the contact surface 21 of the front pier 20 and the contact surface 81 of the rear fastening seat 80 abuts the contact surface 31 of the rear pier 30. The contact surfaces 71/81 of each of the front fastening 70 and the rear fastening seat 80 has a semicircular groove 72/82 defined therein. A flange 73/83 is formed on a bottom of each of the two semicircular grooves 72/82 of the front fastening seat 70 and the rear fastening seat 80. The front turntable 50 has an upper half selectively rotatably received in the semicircular groove 72 in the front fastening seat 70 and the rear turntable 60 has an upper half selectively rotatably received in the semicircular groove 82 in the rear fastening seat 80.

Multiple fastening members 90 are provided to control a loose/tight condition between the front fastening seat 70/rear fastening seat 80 and the front pier 20/rear pier 30. In the preferred embodiment of the present invention, the multiple fastening members 90 are multiple bolts. At least two threaded holes 210/310 are defined in the contact surface 21/31 of each of the front pier 20 and the rear pier 30. At least two through holes 705/805 are defined in the contact surface 71/81 of each of the front fastening seat 70 and the rear fastening seat 80, wherein each through hole 705 in the front fastening seat 70 aligns with a corresponding one of the at least two threaded holes 210 in the front pier 20 and each through hole 805 in the rear fastening seat 80 aligns with a corresponding one of the at least two threaded hole 310 in the rear pier 30. Each fastening member 90 extends through a corresponding one of the through holes 705/805 in each of the front fastening seat 70 and the rear fastening seat 80, and is tightly screwed into a corresponding one of the threaded hole 210/310 in each of the front pier 20 and the rear pier 30 such that the front pier 20 and the front fastening seat 70 tightly clamp the front turn table 50, and the rear pier 30 and the rear fastening seat 80 tightly clamp the rear turntable 60. On the contrary, when all the fastening members 90 is loosed, the front pier 20 and the front fastening seat 70 release the front turn table 50, and the rear pier 30 and the rear fastening seat 80 release the rear turntable 60 such that the rotary seat 40 is rotatable relative to the base member 10 and the operating angle of the rotary seat 40 can be adjusted relative to the base member 10.

Figure 3:
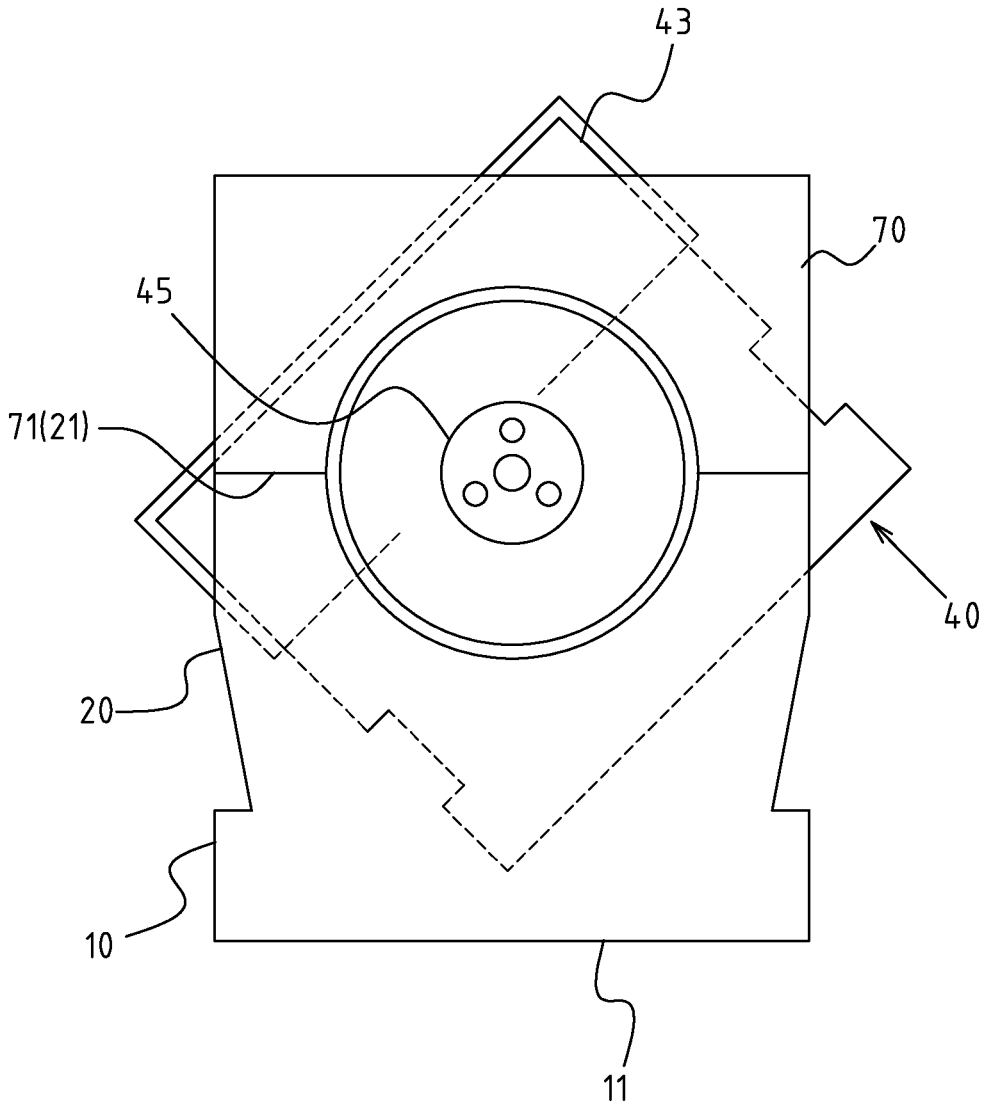
FIG. 3 is an operational view of the vise in FIG. 1 when adjusting the operating angle.

As the above described structures and elements, the front turntable 50 is tightly clamped by the front pier 20 and the front fastening seat 70, and the rear turntable 60 is tightly clamped by the rear pier 30 and the rear fastening seat 80 such that the rotary seat 40 is fixed relative to the base member 10, as shown in FIG. 1 when the front fastening seat 70 and the front pier 20 is in a tightly fixed condition, and the rear fastening seat 80 and the rear pier 30 is in a tightly fixed condition, that is, the contact surface 71 of the front fastening seat 70 tightly abuts against the contact surface 21 of the front pier 20 and the contact surface 81 of the rear fastening seat 80 tightly abuts against the contact surface 31 of the rear pier 30. On the contrary, with reference to FIG. 3, the front turntable 50 and the rear turntable 60 are released, and the rotary seat 40 can be rotated relative to the base member 10 for adjusting a working angle of a fixed work-piece (not shown) when the front fastening seat 70 and the front pier 20 is in a loosed condition, and the rear fastening seat 80 and the rear pier 30 is in a loosed condition.

A series of scales 501 is formed on a front side of the front turntable 50 and an indicator 706 is formed on front fastening seat 70. The adjusting angle of the rotary seat 40 can be easily read and the adjusting precision is promoted by reading a relative relationship between the series scales 501 and the indicator 706.

Figure 4:
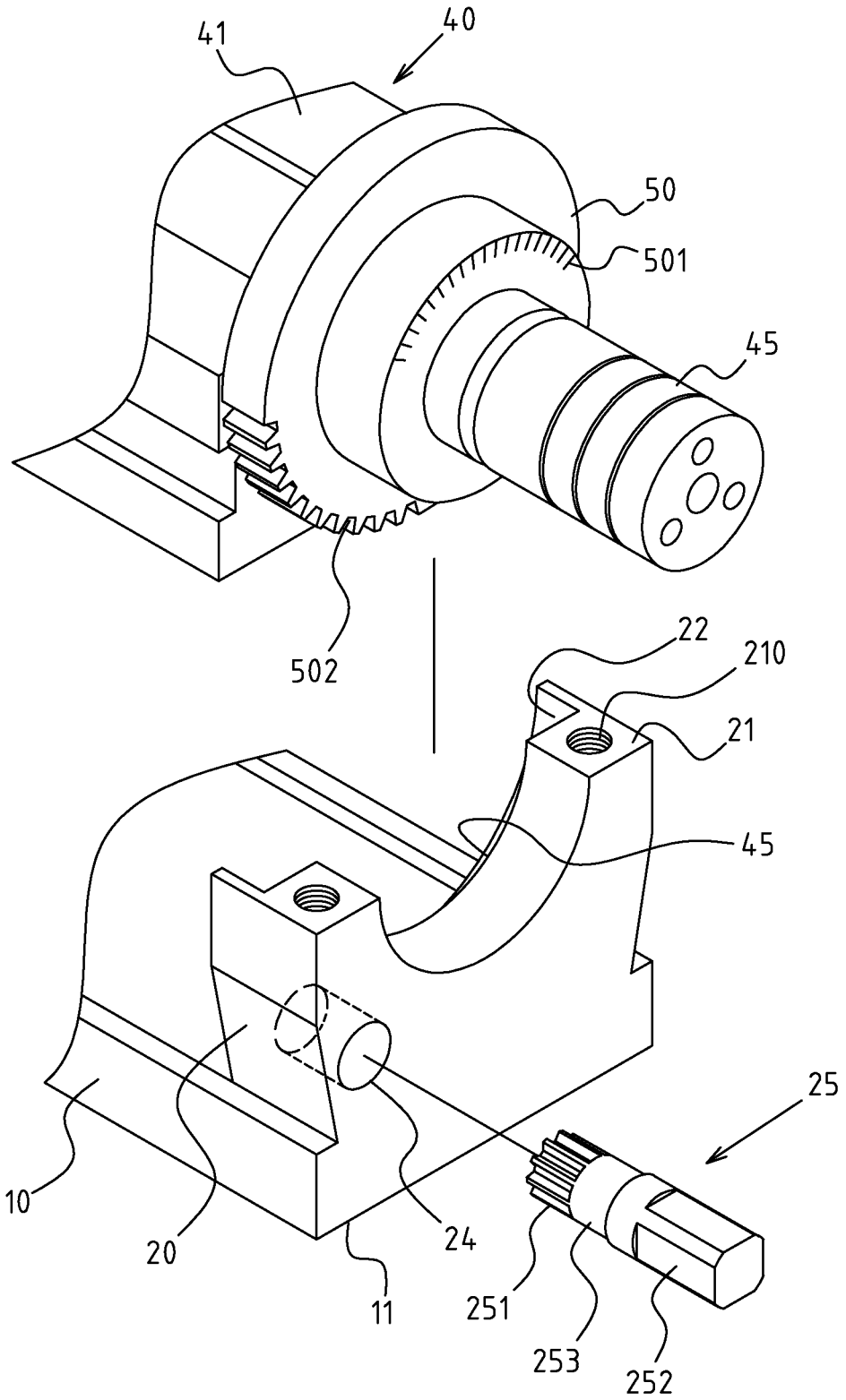
FIG. 4 is a partially exploded perspective view of a second preferred embodiment of the vise with an adjustable operating angle in accordance with the present invention.
Figure 5:
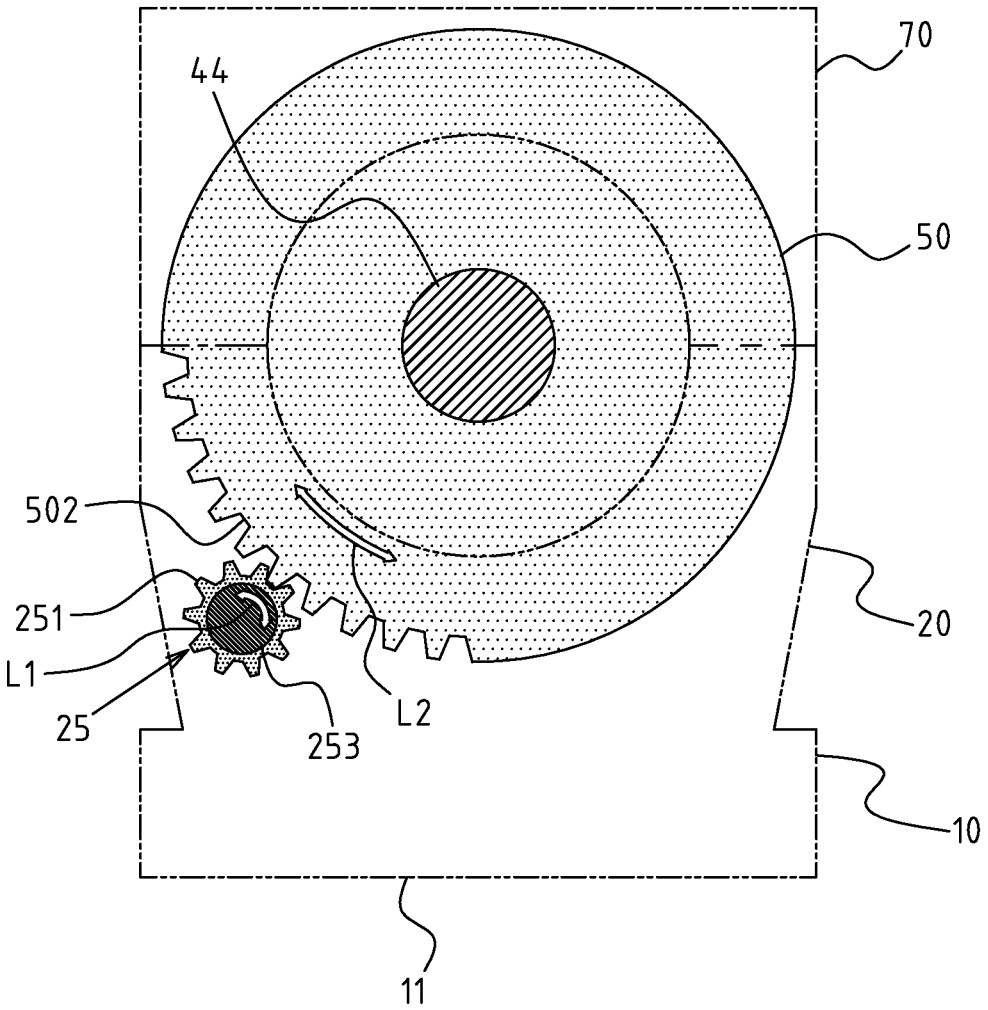
FIG. 5 is an operational view of a second preferred embodiment of the vise with an adjustable operating angle in accordance with the present invention.

With reference to FIG. 4 that shows a second embodiment of the present invention, in this embodiment, a toothed portion 502 is formed on a lower edge of the front turntable 50. A hole 24 is laterally defined in the front pier 20. A drive element 25 is rotatably inserted into the hole 24. The drive element 25 includes a drive portion 252 formed on a front end thereof, a toothed portion 251 formed on a rear end thereof and a pivot portion 253 formed between the drive portion 252 and the toothed portion 251 of the drive element 25, wherein the pivot portion 253 is rotatably received in the hole 24 in the front pier 20 such that the drive element 25 is rotatable relative to the front pier 20. Further with reference to FIG. 5, the toothed portion 251 of the drive portion 25 is engaged to the toothed portion 502 of the front turntable 50 such that the front turntable 50 is reciprocally rotated along a direction of the arrow L2, in FIG. 5, when the drive element 25 is reciprocally rotated relative to the front pier 20 along a direction of the arrow L1, in FIG. 5 for reciprocally rotating the rotary seat 40 to adjust the operating angle. An operating type of the drive portion 252 is selected from the group consisted of polygonal shaft, polygonal groove, I-shaped groove and cross groove according to various hand tools for easily driving the drive element 25. By the engaged toothed portion 251/502 of each of the drive element 25 and the front turntable 50, the rotary seat 40 is smoothly operated when fine adjusting the operating angle thereof.

Figure 6:
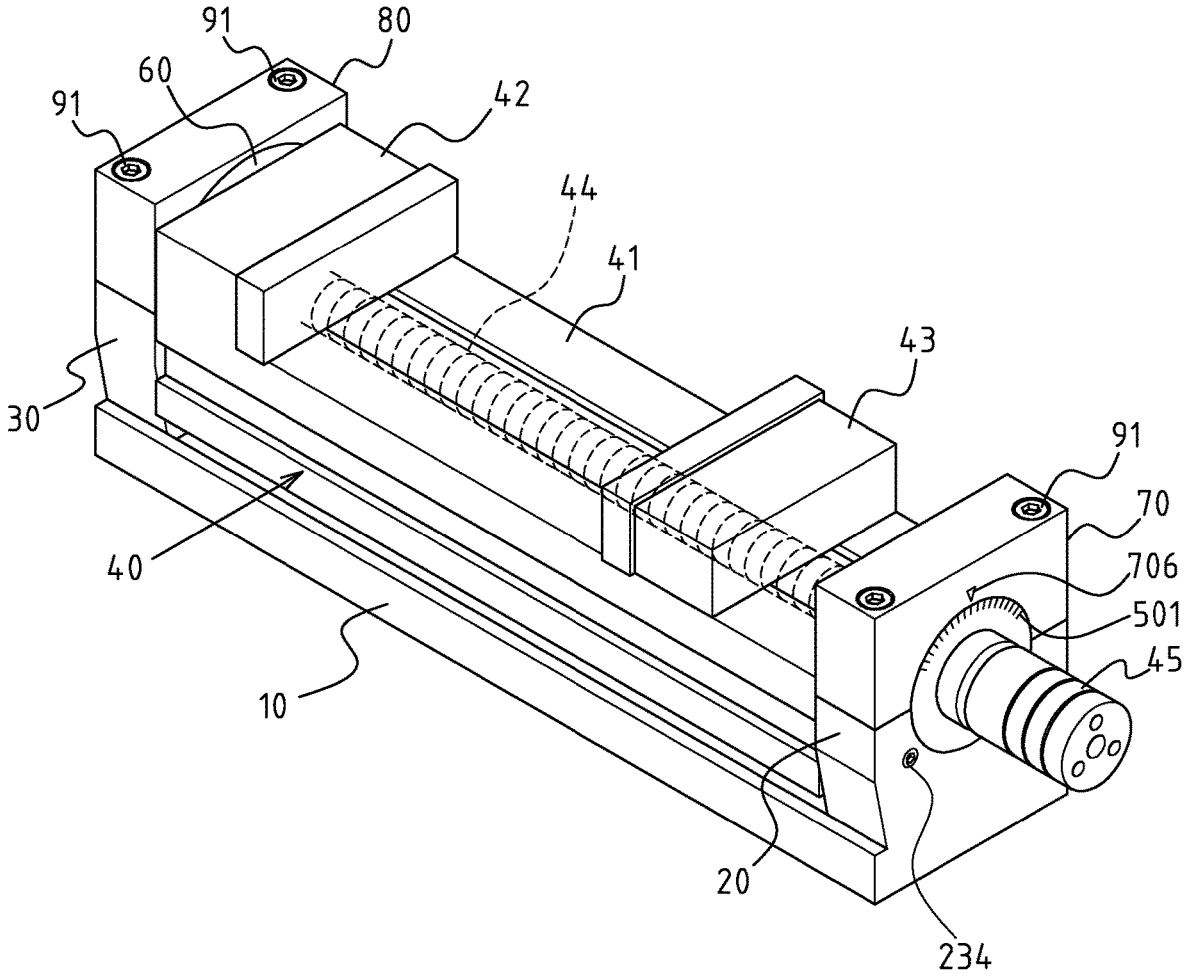
FIG. 6 is a perspective view of a third preferred embodiment of a vise with an adjustable operating angle in accordance with the present invention.
Figure 7:
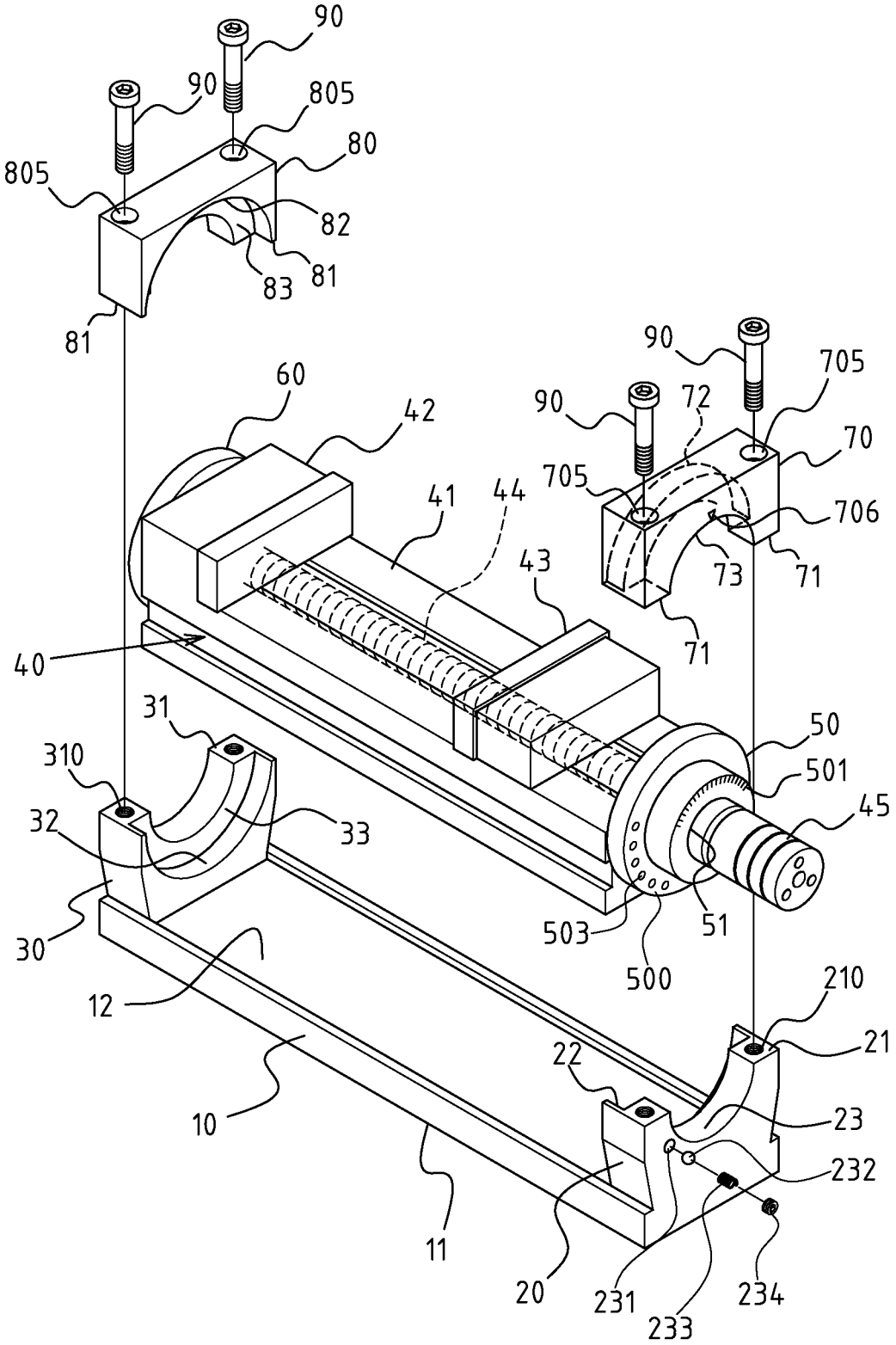
FIG. 7 is an exploded perspective view of the vise in FIG. 6.
Figure 8:
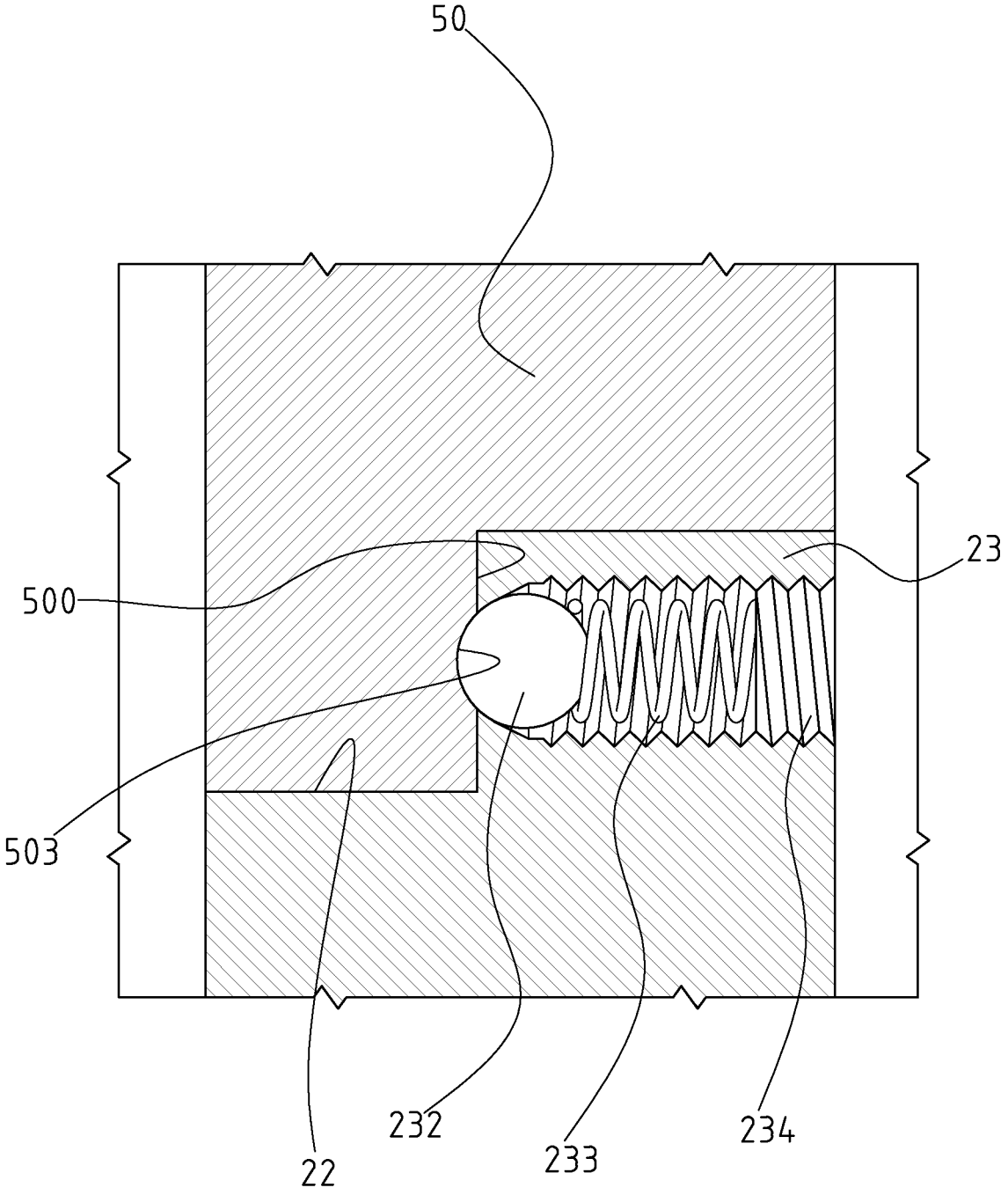
FIG. 8 is a partially cross-sectional view of the vise in FIG. 6.

With reference to FIGS. 6, 7 and 8 that show a third preferred embodiment of the present invention, the this embodiment, the front turntable 50 is formed with a curved face 500 corresponding to the flange 23 of the front pier 20, wherein a series of dimples 503 is defined in the curved face 500 for an operator to easily rotated the rotary seat 40 relative to the base member 10 step by step at a specific angle. The front pier 20 includes a through hole 231 laterally defined in the flange 23 thereof. A steel ball 232, a pre-compressed spring 233 is sequentially mounted into the through hole 231 in the front pier 20. A plug 234 is mounted into the through hole 231 in the front pier 20 to prevent the steel ball 232 and the pre-compressed spring 233 from being detached from the front pier 20. The steel ball 232 is partially engaged into a corresponding one of the series of dimples 503 after rotating the rotary seat 40 relative to the front pier 20 to adjust the operating angle of the rotary seat for temporarily holding the rotary seat 40 in place.

Figure 9:
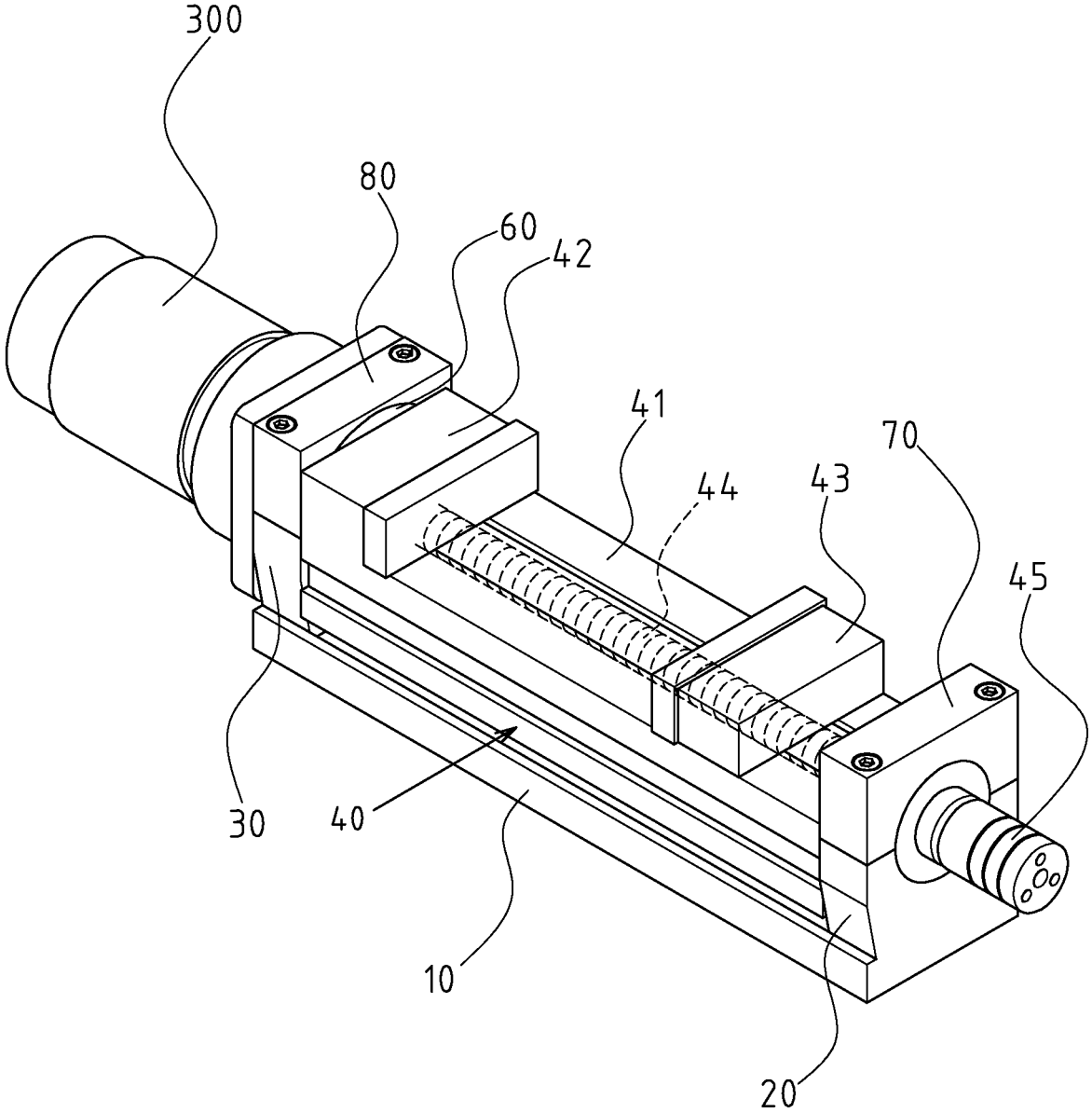
FIG. 9 is a perspective view of a fourth preferred embodiment of a vise with an adjustable operating angle in accordance with the present invention.

With reference to FIG. 9 that shows a fourth preferred embodiment on the present invention, the this embodiment, a servo motor 300 is mounted onto the rear pier 30 and connected to the rear turntable 60. The servo 300 drives and rotates the rear turntable 60 and the platform 41 on the rotary seat 40 to adjust the operating angle of the rotary seat 40 when the front fastening seat 70 and the front pier 20 is in a loosed condition, the rear fastening seat 80 and the rear pier 30 is in a loosed condition and the rotary seat 40 is rotatable relative to the base member 10.

Although the invention has been explained in relation to its preferred embodiment, it is to be understood that many other possible modifications and variations can be made without departing from the spirit and scope of the invention as hereinafter claimed.

I claim:

1. A vise with an adjustable operating angle, comprising:

a base member formed with a bottom and a top surface;

a front pier and a rear pier respectively formed on a front end and a rear end of the top surface of the base member, each of the front pier and the rear pier formed with a contact surface and each of the two contact surfaces having a semicircular groove defined therein; a flange formed on a bottom of each of the two semicircular grooves;

a rotary seat mounted onto the front pier and the rear pier, the rotary seat including a platform, a fixed jaw, a movable jaw, a lead screw and a power brake, wherein the platform is pivoted to the front pier and the rear pier, the fixed jaw secured on a rear end of the platform and the movable jaw movably mounted onto the platform, the lead screw rotatably mounted in the platform for driving the movable jaw and making the movable jaw reciprocally moved relative to the platform, the power brake disposed on a front end of the lead screw and extending through the front pier, the power brake including power force elements disposed therein for enhancing a clamping effect of the fixed jaw and the movable jaw and providing an anti-loose function;

a front turntable and a rear turntable respectively secured on a front end and the rear end of the platform, wherein each of the front turntable and the rear turntable is a circular structure and co-axially corresponds to the lead screw, the front turntable and rear turntable respectively having a bottom half selectively rotatably received in the semicircular groove of a corresponding one of the front pier and the rear pier, the flange of the front pier and the flange of the rear pier respectively inwardly and movably abutting against the front turntable and the rear turntable, the front turntable having a through hole co-axially defined therein, wherein the front end of the lead screw extends through the through hole in the front turntable;

a front fastening seat and a rear fastening seat respectively mounted onto the front pier and the rear pier, the front fastening seat and the rear fastening seat respectively including a contact surface formed on a bottom of each of the front fastening seat and the rear fastening seat, wherein the contact surface of the front fastening seat abuts the contact surface of the front pier and the contact surface of the rear fastening seat abuts the contact surface of the rear pier, the contact surfaces of each of the front fastening and the rear fastening seat having a semicircular groove defined therein, a flange formed on a bottom of each of the two semicircular grooves of the front fastening seat and the rear fastening seat, the front turntable having an upper half selectively rotatably received in the semicircular groove in the front fastening seat and the rear turntable having an upper half selectively rotatably received in the semicircular groove in the rear fastening seat; and multiple fastening members provided to control a loose/tight condition between the front fastening seat/rear fastening seat and the front pier/rear pier, wherein the multiple fastening members are multiple bolts, at least two threaded holes defined in the contact surface of each of the front pier and the rear pier, at least two through holes defined in the contact surface of each of the front fastening seat and the rear fastening seat, wherein each through hole in the front fastening seat aligns with a corresponding one of the at least two threaded holes in the front pier and each through hole in the rear fastening seat aligns with a corresponding one of the at least two threaded hole in the rear pier, each fastening member extending through a corresponding one of the through holes in each of the front fastening seat and the rear fastening seat, and tightly screwed into a corresponding one of the threaded hole in each of the front pier and the rear pier such that the front pier and the front fastening seat tightly clamp the front turn table, and the rear pier and the rear fastening seat tightly clamp the rear turntable, when all the fastening members is loosed, the front pier and the front fastening seat releasing the front turn table, and the rear pier and the rear fastening seat releasing the rear turntable such that the rotary seat is rotatable relative to the base member and the operating angle of the rotary seat is adjusted relative to the base member.

2. The vise with an adjustable operating angle as claimed in claim 1, wherein a toothed portion is formed on a lower edge of the front turntable and a hole is laterally defined in the front pier, a drive element rotatably inserted into the hole, the drive element including a drive portion formed on a front end thereof, a toothed portion formed on a rear end thereof and a pivot portion formed between the drive portion and the toothed portion of the drive element, wherein the pivot portion is rotatably received in the hole in the front pier such that the drive element is rotatable relative to the front pier, the toothed portion of the drive portion engaged to the toothed portion of the front turntable such that the front turntable is reciprocally rotated when the drive element is reciprocally rotated relative to the front pier for reciprocally rotating the rotary seat to adjust the operating angle, by the engaged toothed portion of each of the drive element and the front turntable, the rotary seat smoothly operated when fine adjusting the operating angle thereof.

3. The vise with an adjustable operating angle as claimed in claim 2, wherein a series of scales is formed on a front side of the front turntable and an indicator is formed on front fastening seat, an adjusting angle of the rotary seat is easily read and the adjusting precision is promoted by reading a relative relationship between the series scales and the indicator.

4. The vise with an adjustable operating angle as claimed in claim 1, wherein the front turntable is formed with a curved face corresponding to the flange of the front pier and a series of dimples is defined in the curved face for an operator to easily rotated the rotary seat relative to the base member step by step at a specific angle, the front pier including a through hole laterally defined in the flange thereof a steel ball, a pre-compressed spring sequentially mounted into the through hole in the front pier, a plug mounted into the through hole in the front pier to prevent the steel ball and the pre-compressed spring from being detached from the front pier, the steel ball partially engaged into a corresponding one of the series of dimples after rotating the rotary seat relative to the front pier to adjust the operating angle of the rotary seat for temporarily holding the rotary seat in place.

5. The vise with an adjustable operating angle as claimed in claim 4, wherein a series of scales is formed on a front side of the front turntable and an indicator is formed on front fastening seat, an adjusting angle of the rotary seat is easily read and the adjusting precision is promoted by reading a relative relationship between the series scales and the indicator.

6. The vise with an adjustable operating angle as claimed in claim 1, wherein a servo motor is mounted onto the rear pier and connected to the rear turntable, the servo driving and rotating the rear turntable and the platform on the rotary seat to adjust the operating angle of the rotary seat when the front fastening seat and the front pier is in a loosed condition, the rear fastening seat and the rear pier is in a loosed condition and the rotary seat is rotatable relative to the base member.

* * * * *